US009970429B2

(12) United States Patent
Han et al.

(10) Patent No.: US 9,970,429 B2
(45) Date of Patent: May 15, 2018

(54) DIAPHRAGM PUMP

(71) Applicant: Flowserve Management Company, Irving, TX (US)

(72) Inventors: Yang Han, Bethlehem, PA (US); Sidney Lowe, Moyock, NC (US)

(73) Assignee: Flowserve Management Company, Irving, TX (US)

( * ) Notice: Subject to any disclaimer, the term of this patent is extended or adjusted under 35 U.S.C. 154(b) by 744 days.

(21) Appl. No.: 14/332,627

(22) Filed: Jul. 16, 2014

(65) Prior Publication Data

US 2016/0017881 A1 Jan. 21, 2016

(51) Int. Cl.

| | |
|---|---|
| ***F04B 49/24*** | (2006.01) |
| ***F04B 43/02*** | (2006.01) |
| ***F04B 45/04*** | (2006.01) |
| ***F04B 15/02*** | (2006.01) |
| ***F04B 15/04*** | (2006.01) |
| ***F04B 49/035*** | (2006.01) |

(52) U.S. Cl.

CPC ..... *F04B 43/02* (2013.01); *F04B 15/02* (2013.01); *F04B 15/04* (2013.01); *F04B 45/04* (2013.01); *F04B 49/035* (2013.01)

(58) Field of Classification Search

CPC ..... F04B 15/02; F04B 15/04; F04B 43/02; F04B 49/035; F04B 45/04; F04B 17/003; F04B 43/04; F04B 45/047; F04B 45/053; F04B 43/06; F04B 43/026; F16K 15/148; Y10T 137/789

USPC ..... 417/395, 413.1

See application file for complete search history.

(56) References Cited

U.S. PATENT DOCUMENTS 4,610,605 A 9/1986 Hartley
4,762,149 A 8/1988 Pickl, Jr.
(Continued)

FOREIGN PATENT DOCUMENTS

JP H08326938 A 12/1996
JP H11153239 A 6/1999
(Continued)

OTHER PUBLICATIONS

International Preliminary Report on Patentability for Appl No. PCT/US2015/046551 dated Nov. 27, 2015.
(Continued)

*Primary Examiner* — Dominick L Plakkoottam
(74) *Attorney, Agent, or Firm* — Maine Cernota & Rardin

(57) ABSTRACT

A diaphragm pump includes a bypass valve and spring that are easy to install and do not require support by a special plug or mounting bracket. The pump outlet is perpendicular to the input, causing the bypass valve and spring to operate laterally as seen from the pump base. When installed, the bypass spring is suspended between the bypass valve and a simple "T" insert that is held in place within the pump by interior elements of the pump, without need for a special plug or bracket. The longitudinal strength of the housing is increased by providing a cone-shaped outer wall having a scalloped inner surface. The conical shape enhances the housing's resistance to longitudinal forces applied to the diaphragm. The cusps of the scalloped shape provide wall support ribs and locations for assembly screws, while increasing the interior volume and reducing the pump weight.

16 Claims, 9 Drawing Sheets

(56) References Cited

U.S. PATENT DOCUMENTS

| | | | | |
|---|---|---|---|---|
| 5,571,000 | A | 11/1996 | Zimmermann et al. | |
| 5,800,136 | A | 9/1998 | Kurth et al. | |
| 6,092,998 | A | 7/2000 | Dexter et al. | |
| 6,299,414 | B1 * | 10/2001 | Schoenmeyr | F04B 43/009 417/244 |
| 6,648,004 | B2 | 11/2003 | Lau | |
| 7,988,266 | B2 | 8/2011 | Xiao et al. | |
| 8,070,458 | B2 | 12/2011 | Meza | |
| 2005/0126649 | A1 * | 6/2005 | Onishi | F04B 43/046 137/854 |

FOREIGN PATENT DOCUMENTS

| | | | |
|---|---|---|---|
| JP | 2008303951 | A | 12/2008 |
| JP | 2009250363 | A | 10/2009 |

OTHER PUBLICATIONS

International Search Report for Appl No. PCT/US2015/046551 dated Nov. 30, 2015.
Written Opinion of the International Search Report for Appl No. PCT/US2015/046551 dated Nov. 27, 2015.

* cited by examiner

DIAPHRAGM PUMP

FIELD OF THE INVENTION

The invention relates to diaphragm pumps, and more particularly, to bypass valves in diaphragm pumps.

BACKGROUND OF THE INVENTION

Diaphragm pumps are used in many pumping applications, and offer several distinct advantages as compared to rotary and other types of pumps. Diaphragm pumps have good suction lift characteristics, good dry running characteristics, and can be up to 97% efficient. Various types of diaphragm pump work well with air and with highly viscous liquids, and can have good self-priming capabilities. Depending on the design, diaphragm pumps can also minimize the number of moving parts that are in contact with the process fluid. This can be ideal for applications to gritty and/or highly viscous liquids, and to corrosive liquids and gases.

FIGS. 1A-1C are highly simplified cross-sectional drawings that illustrate the basic components included in virtually all diaphragm pumps of the prior art. The pump shown in the figures includes a pump housing 118 that surrounds a pumping chamber 100 having a fluid inlet 102 and a fluid outlet 104. The pumping chamber 100 is bounded on one side by a flexible diaphragm 106, which can be distorted so as to increase and/or decrease the volume of the pumping chamber 100. Inlet and outlet valves 108, 110 control the flow of process fluid, so that when the volume of the pumping chamber 100 is increased, as shown in FIG. 1A, process fluid is drawn into the pumping chamber 100 through the fluid inlet 102 and through the inlet valve 108, and when the volume of the pumping chamber 100 is decreased, as shown in FIG. 1B, process fluid flows out of the pumping chamber 100 through the outlet valve and into the outlet.

In some applications, there is a risk that a diaphragm pump may continue to operate when the outlet 110 is blocked, due for example to a clog or to inadvertent closing of an outlet valve. This can cause the pressure in the pumping chamber 100 and outlet 104 to rise to dangerous levels, which could lead to rupture of the diaphragm and/or damage to other components. Spilling of toxic process fluid could also result. Accordingly, many diaphragm pumps include a bypass valve 112 that remains closed during normal operation, but opens to allow fluid to flow from the relatively higher pressure outlet 104 to the lower pressure inlet 102 if the pressure difference rises above a preset threshold value. Typically, the bypass valve is held shut by a bypass spring 114, and the tension of the bypass spring determines the threshold pressure difference that will cause the bypass valve 112 to open. FIG. 1C illustrates flow of process fluid when the outlet 104 is blocked and the bypass valve is open, allowing fluid to flow from the pumping chamber 100 into the outlet 104, through the bypass valve 112 and back into the inlet 102

Of course, the base of the bypass spring 114 must be supported by something. In the simplified example of FIGS. 1A-1C, the bypass valve and spring are installed through an opening in the bypass housing, which is then sealed by a plug 116 that supports the base of the bypass spring 114. However, this can be an undesirable solution, because the bypass plug provides an added opportunity for the system to leak. Another approach is to fasten a bracket to the inner walls within the pump housing to support the spring, but this can add complexity and cost to the design.

It is also frequently desirable to maximize the size of the diaphragm 106 and/or pumping chamber 100, while minimizing the outer volume and weight of the pump. One approach is to make the walls of the pump housing 108 thinner, but this approach is limited because the pump housing must have sufficient strength to withstand the mechanical forces that are applied to it by fluid pressures and flow, and by the mechanical manipulation of the diaphragm. It can be especially difficult to make the walls thinner when the outlet 104 is perpendicular to the input 102, as compared to being in-line with the input 102 as shown in FIGS. 1A-1C.

What is needed, therefore, is a diaphragm pump having a maximized interior pumping chamber volume and a minimized outer size and weight, where the diaphragm pump includes a bypass valve that is easy to install and does not require support by a special plug or mounting bracket.

SUMMARY OF THE INVENTION

A diaphragm pump having a maximized interior diaphragm size and pumping chamber volume and a minimized outer size and weight includes a bypass valve and spring that are easy to install and do not require support by a special plug or mounting bracket. The outlet of the diaphragm pump is perpendicular to its inlet, which causes the bypass valve and spring to operate laterally as seen from the base of the pump, where the diaphragm is located. The bypass valve and spring are installed through the base of the pump, the bypass spring being suspended between the bypass valve and a simple "T" insert that is held in place by the interior structure of the pump, without need for brackets or fasteners.

The interior size of the pump housing is maximized while the exterior size and weight are minimized by providing a substantially conical housing having a thickness that varies around its circumference in a cycloid pattern, thereby providing support ribs and secure locations for assembly screws, while significantly increasing the interior volume and reducing the weight as compared to a housing with uniform thickness. The truncated cone shape of the housing provides enhanced mechanical strength for withstanding forces applied longitudinally to the diaphragm at the base of the housing, as well as the longitudinal mechanical forces applied by the fluid flow and valve operations. The right-angle arrangement of the inlet and outlet provide for a compact pump that is ideal for certain applications.

The present invention is a diaphragm pump for pumping a process fluid. The diaphragm pump includes a pump housing having an outer wall, an inlet region within the pump housing into which process fluid flows in an inlet direction, an outlet region within the pump housing from which process fluid flows out in an outlet direction, the outlet region being separated from the inlet region by a separating boundary, a pumping zone that is separated from the inlet region by at least one inlet valve, and from the outlet region by at least one outlet valve, the pumping zone being partially bounded by a flexible diaphragm, a bypass valve that penetrates the separating boundary, the bypass valve being configured, when open, to allow process fluid to flow from the outlet region into the inlet region a bypass spring having a proximal end and a distal end, the proximal end of the bypass spring being in pressing communication with the bypass valve, and a support insert having a top end in pressing communication with the distal end of the bypass spring, the support insert being held in position within the housing by the bypass valve spring and by positioning elements that abut the support insert without attachment thereto, each of the positioning elements being unitary with a structural element within the pump housing that is required for pumping of process fluid from the inlet region to the outlet region.

In embodiments, the outlet region surrounds the inlet region. In some of these embodiments the separating boundary is substantially cylindrical. In other of these embodiments the separating boundary includes a first boundary segment that is unitary with the pump housing and a second boundary segment that is unitary with a valve support structure that supports at least one of the inlet valves or at least one of the outlet valves.

In various embodiments the positioning elements include at least one positioning element that is unitary with the pump housing. In certain embodiments, the positioning elements include at least one positioning element that is unitary with a valve support structure that supports at least one of the inlet valves or at least one of the outlet valves.

In exemplary embodiments, the support insert includes an insert body having a left face and a right face, the left and right faces being separated by a thickness that is less than a width of the left and right faces, the top of the insert body being terminated by a top extension having a flat upper surface that extends beyond the left and right faces of the insert body. In some of these embodiments the insert body is positioned to allow process fluid to flow in the inlet region past the left and right faces of the insert body. And in other of these embodiments the positioning elements include a slot into which a base of the insert body is inserted.

In embodiments, the outer wall of the pump housing is shaped substantially as a truncated cone, extending at it smaller end to a pump inlet and at its larger end to a pump base. In some of these embodiments, the outer wall of the pump housing makes an angle of approximately 30 degrees with the central axis of the truncated cone.

In various embodiments, an inner surface of the outer wall of the pump housing is cycloid shaped, cusps of the cycloid extending inward to form thickened regions of the pump housing outer wall, and rounded segments of the cycloid curving outward to form thinned regions of the pump housing outer wall. In some of these embodiments, at least one of the thickened regions at the base of the pump housing outer wall includes a threaded hole configured to accept an assembly screw.

Certain embodiments further include a valve support structure that supports the inlet and outlet valves and divides the pumping zone from the inlet and outlet regions, the valve support structure including a positioning member that is unitary therewith and is configured to prevent the support insert from moving in a direction parallel to the inlet direction.

And in other embodiments, the inlet direction is substantially perpendicular to the outlet direction.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1A:
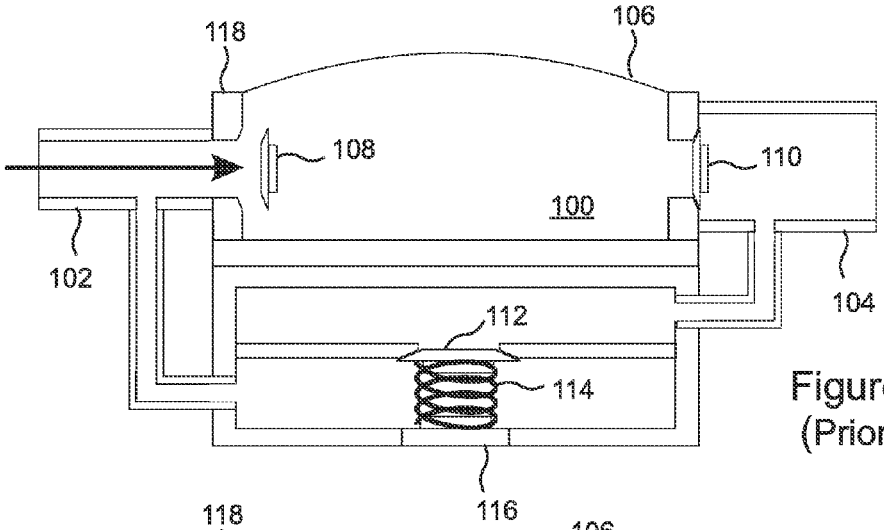
Figure 1A (Prior Art)
FIG. 1A is a cross sectional diagram of a diaphragm pump of the prior art, shown with the diaphragm extended outwards to increase the pumping volume.
Figure 1B:
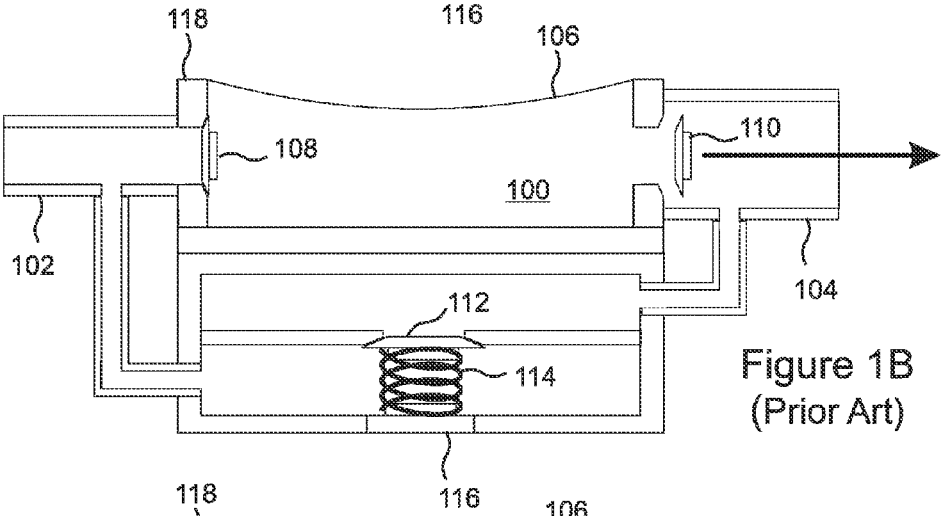
Figure 1B (Prior Art)
FIG. 1B is a cross sectional diagram of the diaphragm pump of FIG. 1A, shown with the diaphragm extended inwards to decrease the pumping volume.
Figure 1C:
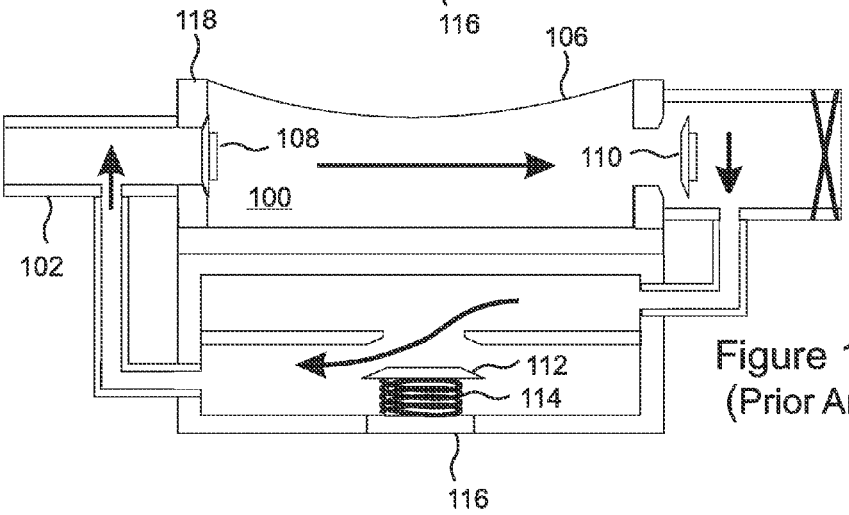
Figure 1C (Prior Art)
FIG. 1C is a cross sectional diagram of the diaphragm pump of FIG. 1A, showing flow of process fluid from the outlet through a bypass valve and into the inlet due to blockage of the outlet.
Figure 2:
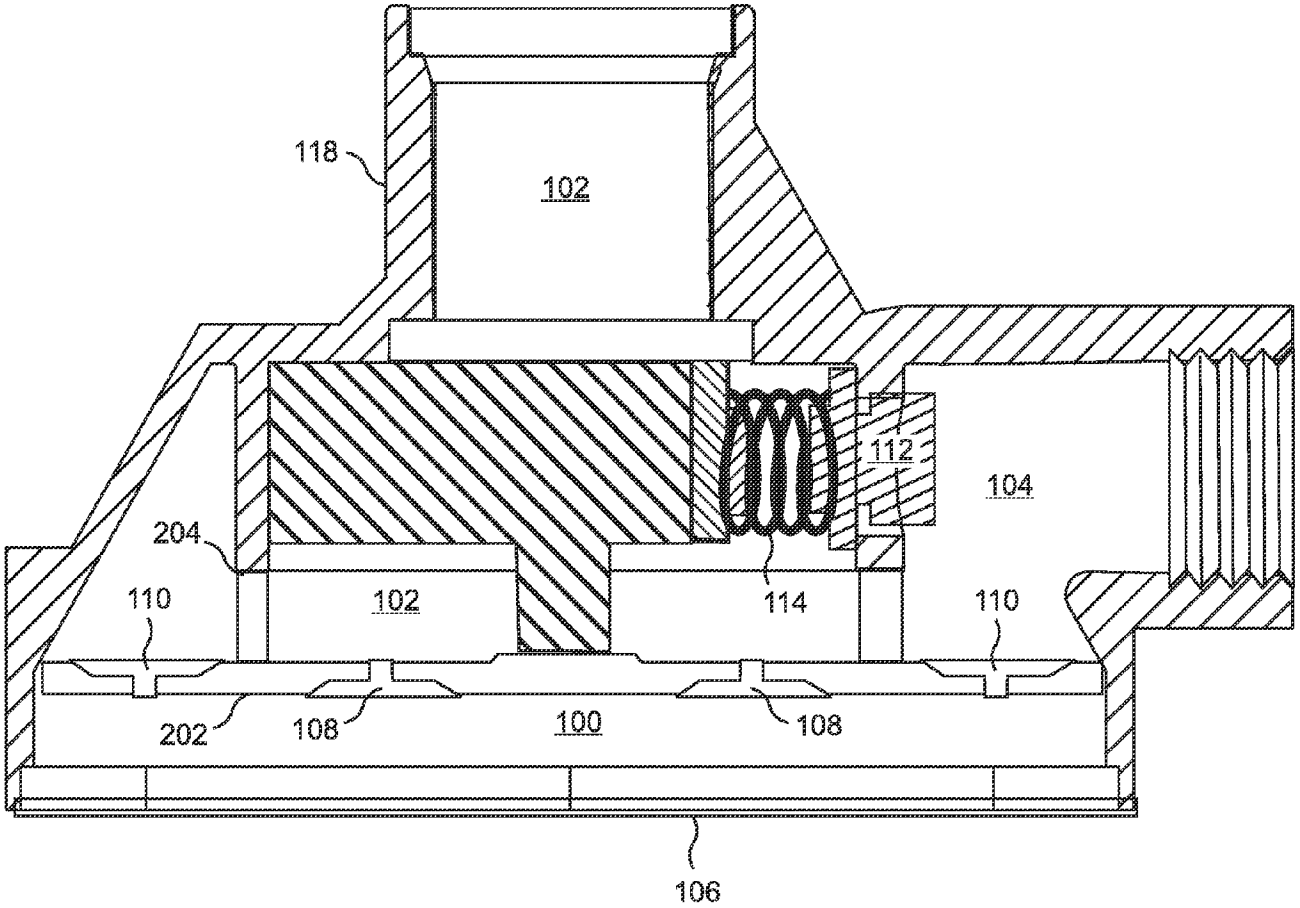
FIG. 2 is a cross sectional side view of an embodiment of the present invention with a T insert, bypass valve, and bypass spring installed therein.
Figure 3A:
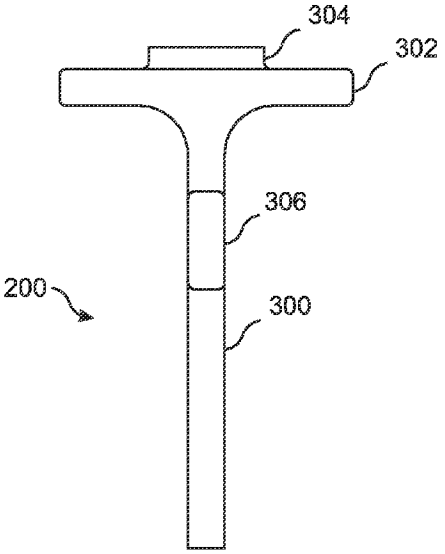
FIG. 3A is a front view drawn to scale of the T insert of FIG. 2.
Figure 3B:
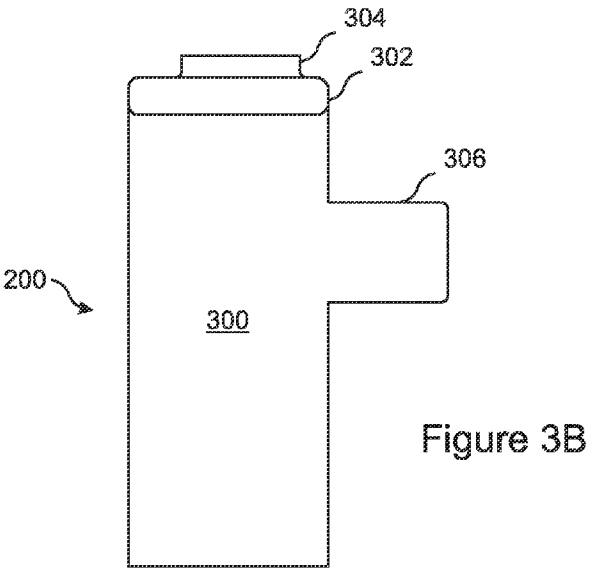
FIG. 3B is a side view drawn to scale of the T insert of FIG. 2.
Figure 3C:
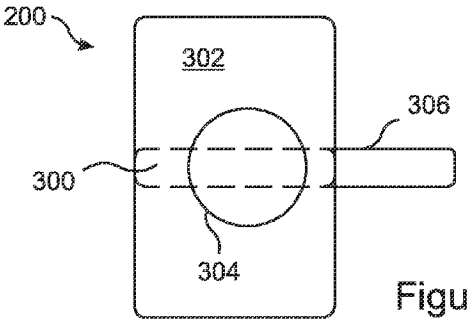
FIG. 3C is a top view drawn to scale of the T insert of FIG. 2.
Figure 3E:
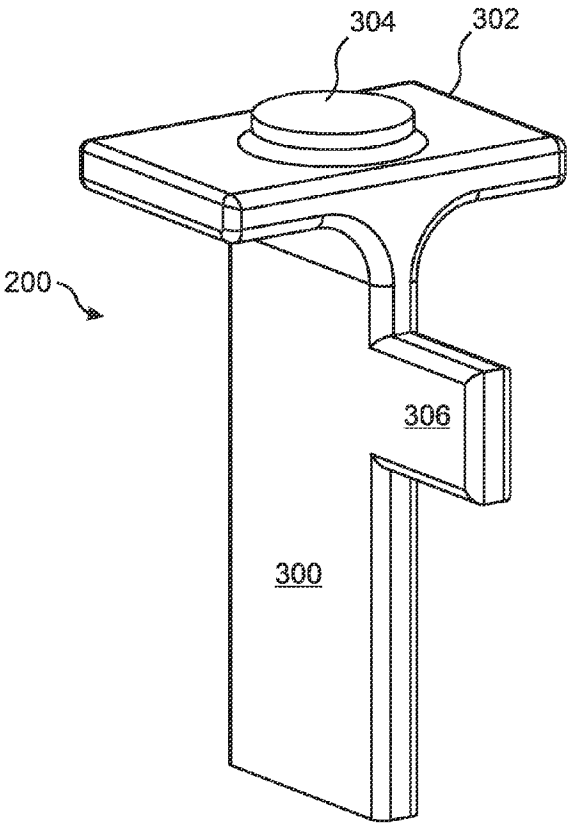
FIG. 3E is a perspective view from the front, drawn to scale, of the T insert of FIG. 2
Figure 3D:
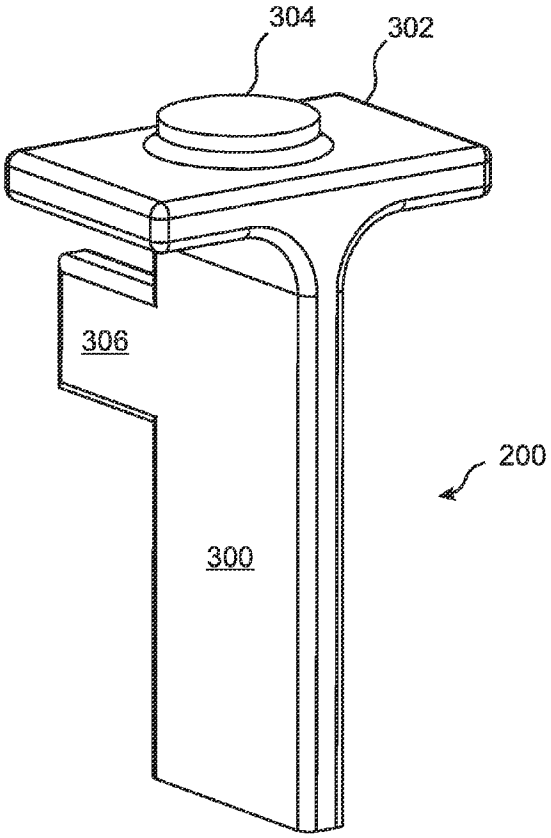
FIG. 3D is a perspective view from the rear, drawn to scale, of the T insert of FIG. 2.

With reference to FIG. 2, a diaphragm pump having a maximized diaphragm size 106 and interior pumping chamber volume 100 and a minimized outer size and weight includes a bypass valve 112 and spring 114 that are easy to install and do not require support by a special plug (116 in FIG. 1) or bracket. In the embodiment of FIG. 2, the outlet 104 of the diaphragm pump is perpendicular to its input 102, which causes the bypass valve 112 and spring 114 to operate laterally as seen from the base of the pump, at the bottom of the figure. The bypass valve 112 and spring 114 are installed through the base of the pump, the bypass spring 114 being suspended between the bypass valve 112 and a simple "T" insert 200 that is prevented from moving out of position by the interior structure of the pump 202, specifically in the embodiment of FIG. 2 by the valve plate, without need for brackets or fasteners. It is important to note that no additional pump elements are required to prevent the T insert 200 from moving out of position, because the T insert 200 is constrained by structures that are unitary with pump elements that are needed for normal operation of the pump, independent of the bypass valve.

It can be seen in FIG. 2 that the inlet region 102 of the pump in this embodiment extends past the T insert 200, and is separated from the pumping volume 100 by a valve plate 202 that supports both the inlet valves 108 and the outlet valves 110. The inlet region 102 is separated from the outlet region 104 by a cylindrical wall 204 formed by a mating of cylindrical extensions of both the pump housing 118 and the valve plate 202. The outlet region 104 is an annular region surrounding the inlet region 102.

With reference to FIGS. 3A through 3E, in embodiments the T insert includes a flat body 300, a perpendicular, flat top 302 that extends outward from both sides of the flat body 300, and a spring mount 304 that extends from the flat top 302. In the embodiment of FIGS. 3A through 3E, the T insert further includes a positioning "finger" 306 that is co-planer with the flat body 300, and extends from the flat body 300 to rest against internal structures within the pump and thereby hold the T insert 200 in place. In the embodiment of FIG. 2, the positioning finger 306 rests against the valve plate 202.

Figure 4A:
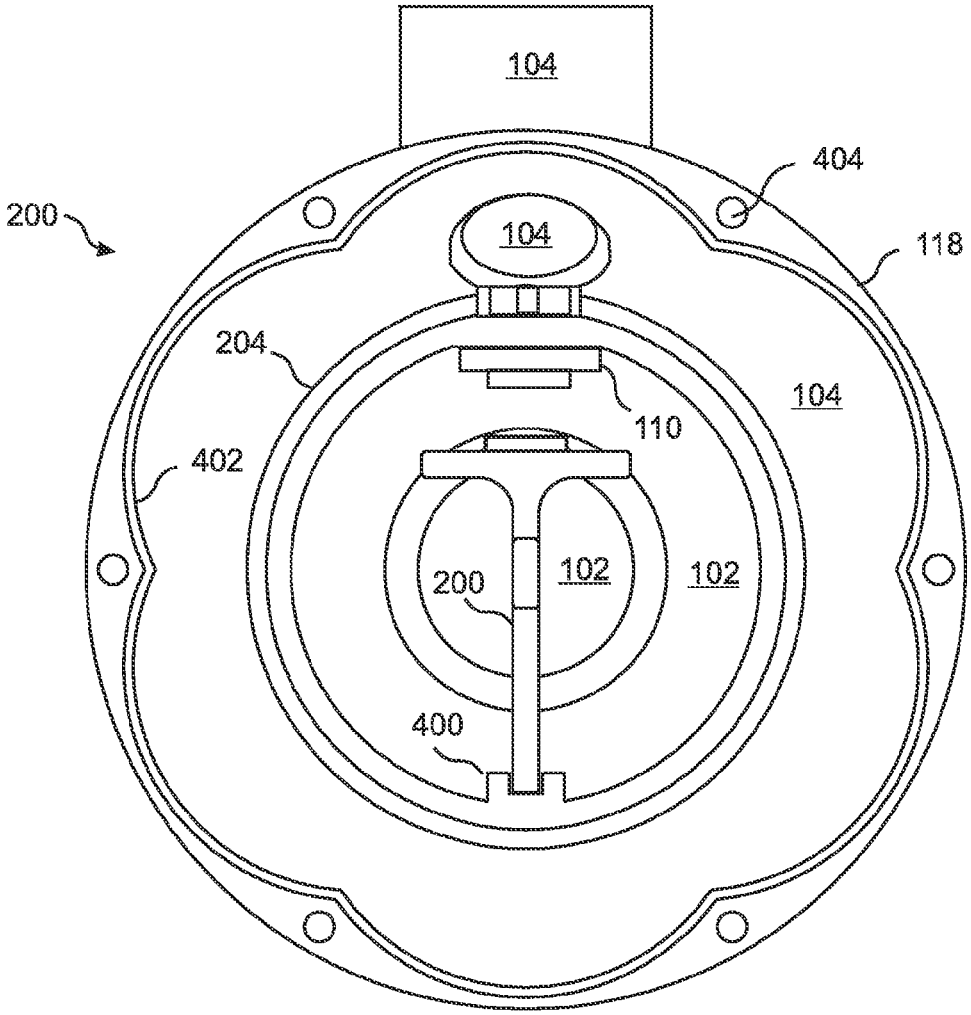
FIG. 4A is a sectional view from below, drawn to scale, of the embodiment of FIG. 2, shown with the T insert and bypass valve installed, but not the bypass spring.

FIG. 4A is a view from below of the pump housing of FIG. 2. The diaphragm 106 and bypass spring 114 have been omitted from the figure so that the T insert 200 and bypass valve 112 can be more easily seen. In this embodiment, the base of the T insert 200 is supported by a slot 400 that is included in the cylindrical wall 204, while the spring 114 supports the top of the T insert 200.

Figure 4B:
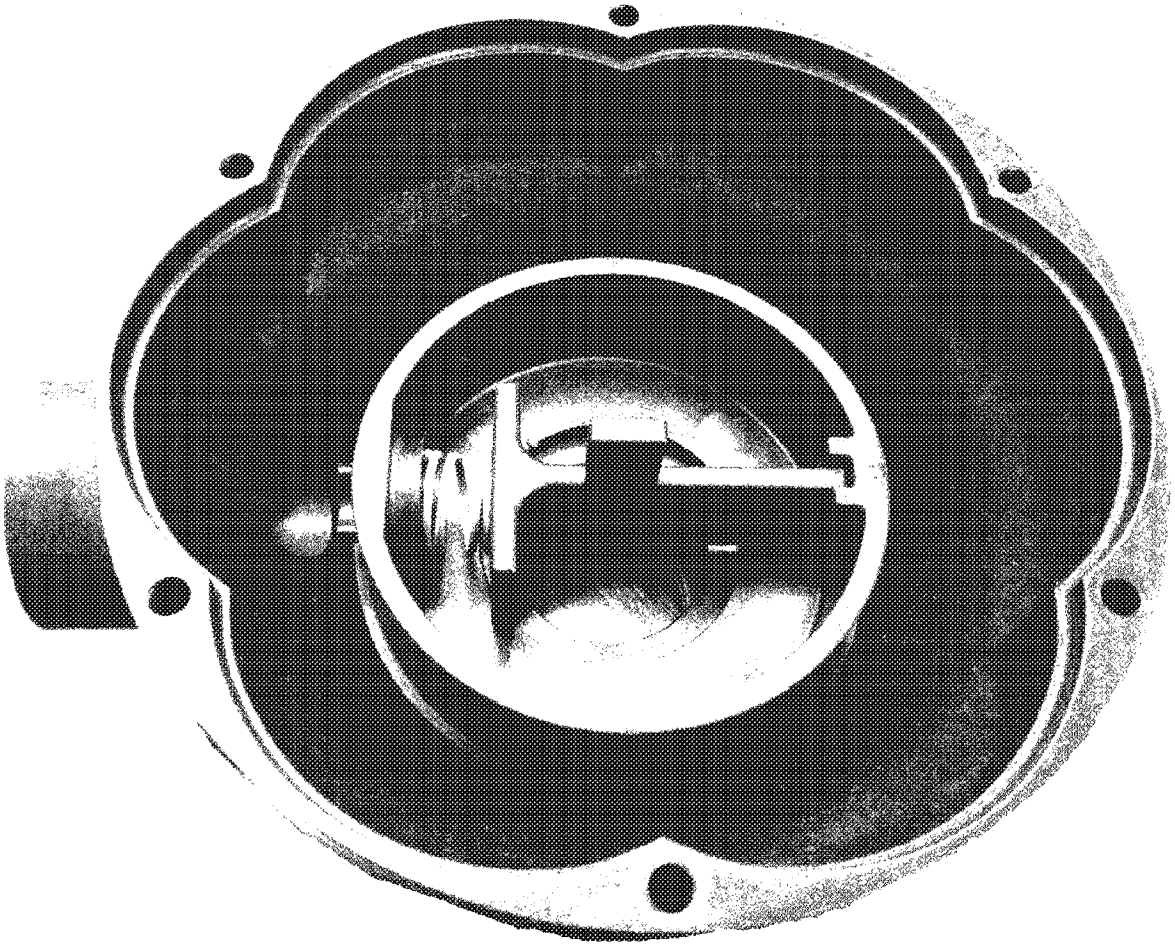
FIG. 4B is a perspective photographic view from below of the embodiment of FIG. 4A.

The cycloid, or "scalloped" interior shape of the pump housing 118 included in some embodiments can also be seen in FIG. 4A. This scalloped shape provides inwardly directed cusps that serve as reinforcing "ribs" for the housing 118 and locations for assembly screw holes 404, while the outwardly curved sections between the cups increase the interior volume of the housing 118 and decreasing its weight as compared to a housing with uniform thickness. FIG. 4B is a perspective photograph of the embodiment of FIG. 4A, wherein the bypass spring 114 has been installed between the bypass valve 112 and the T insert 200.

Figure 5:
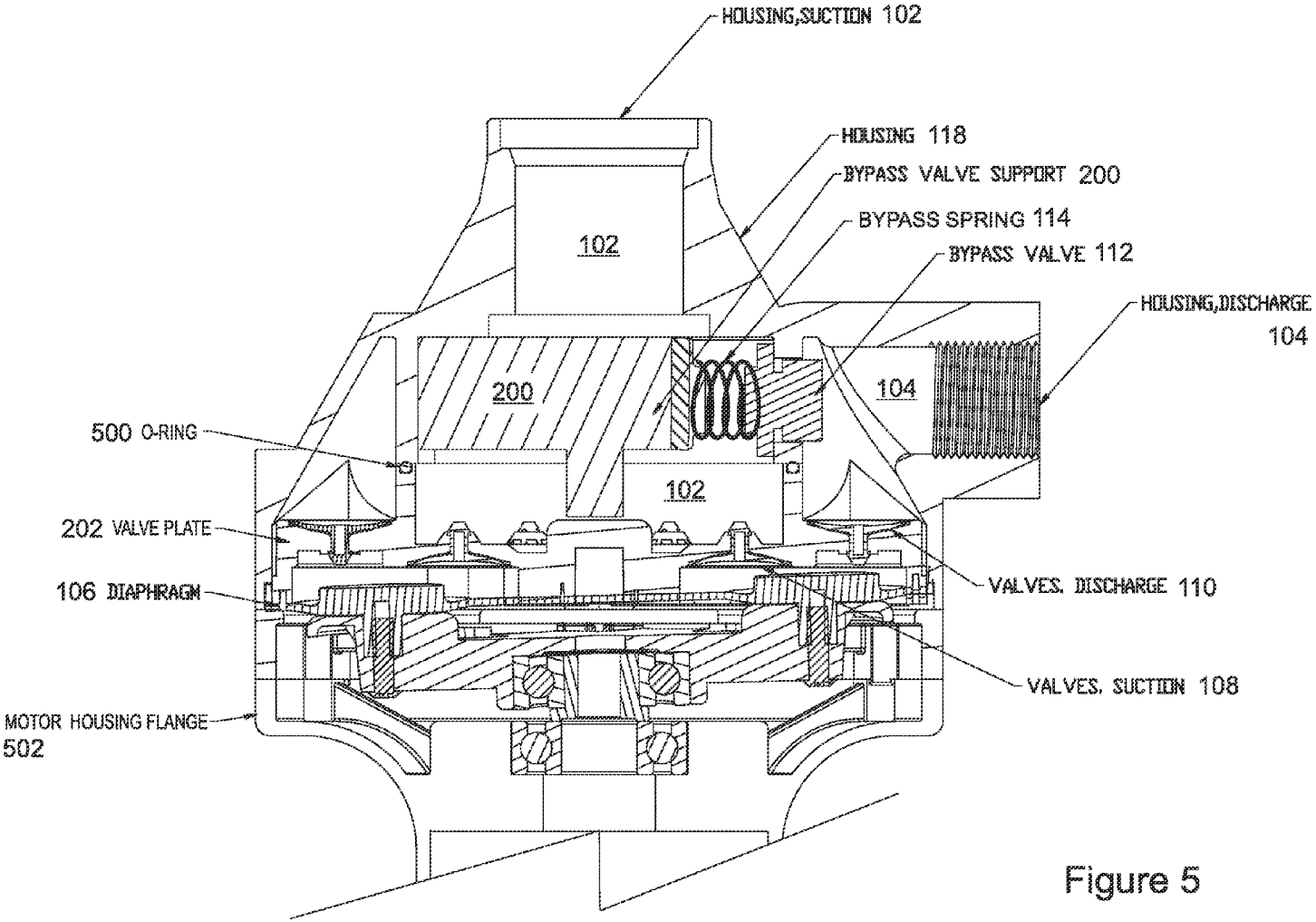
FIG. 5 is a cross sectional side view drawn to scale of an embodiment similar to FIG. 2, but including more elements of the pump assembly.

FIG. 5 is a cross-sectional view drawn to scale of an embodiment similar to FIG. 4A, but showing more structural detail, especially of the diaphragm 106, the inlet valves 108, the outlet valves 110, and the valve plate 202. The O-ring 500 that seals together the cylindrical extensions of the pump housing 118 and the valve plate 202 is also shown, as well as the motor housing flange 502 that attaches to the base of the pump housing 118.

Figure 6:
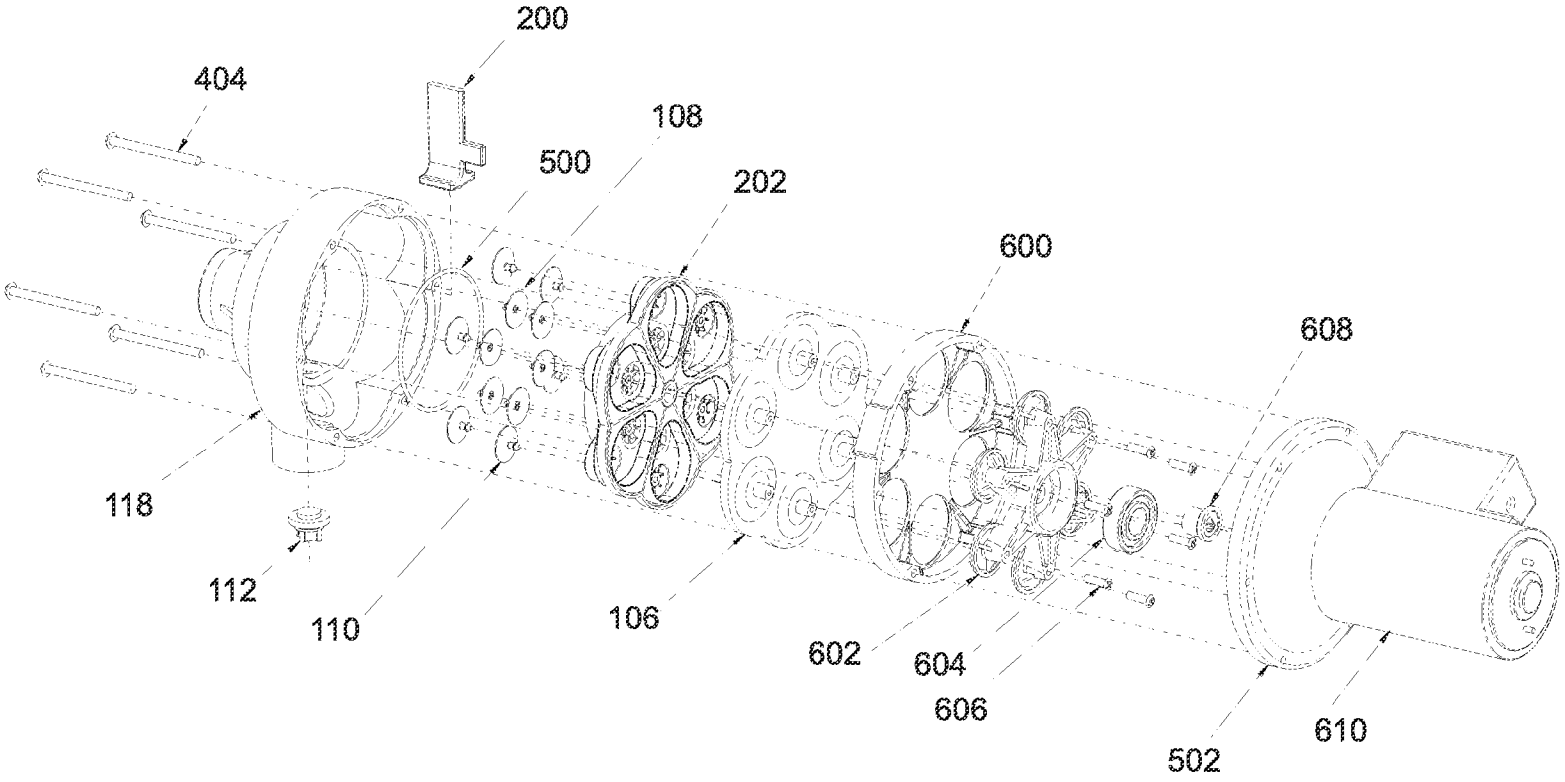
FIG. 6 is an exploded, assembly view drawn to scale of the embodiment of FIG. 5, including additional elements of the pump and motor assembly.

FIG. 6 is an exploded assembly view drawn to scale of the embodiment of FIG. 5. In addition to the elements shown in FIG. 5, FIG. 6 also includes a spacer 600 that provides space for flexing the diaphragm 106, as well as a wobble plate 602 a bearing 604, motor mounting screws 606, a bushing 608, and the motor housing 610.

Figure 7C:
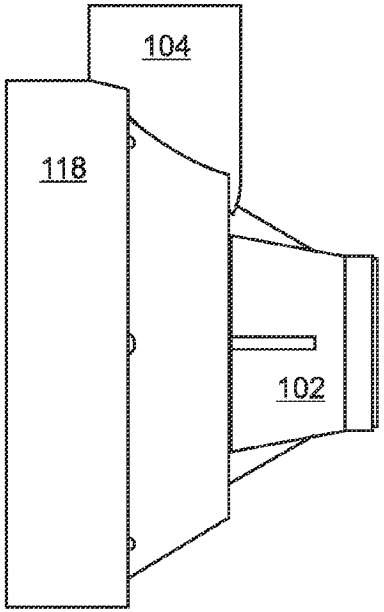
FIG. 7C is a view from the side of the pump housing of FIG. 7A.
Figure 7B:
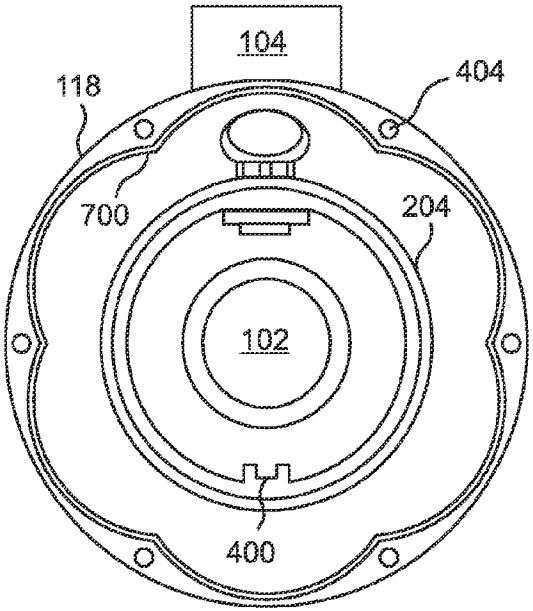
FIG. 7B is a view from below of the embodiment of FIG. 7A.
Figure 7A:
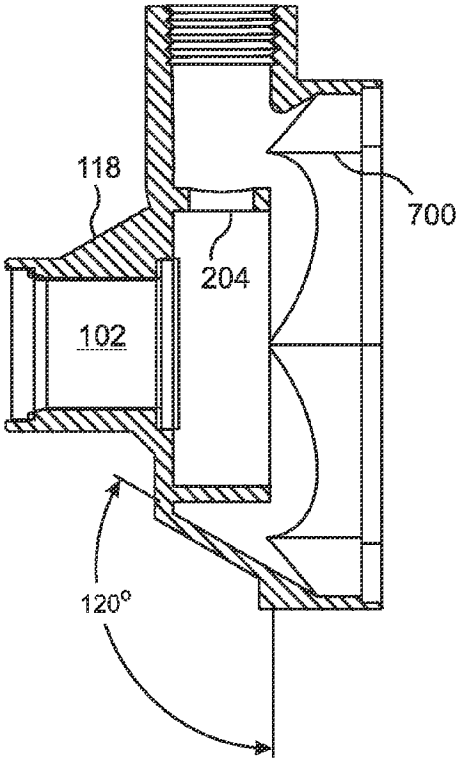
FIG. 7A is a cross sectional side view drawn to scale of the pump housing of the embodiment of FIG. 2, shown without any other elements installed therein.

As noted above, the conical shape of the housing 118 in embodiments provides enhanced mechanical strength for withstanding forces applied longitudinally to the diaphragm 202 at the base of the housing 118, as well as the longitudinal mechanical forces applied by the fluid flow and valve operations. FIG. 7A is a cross-sectional diagram drawn to scale that presents a side view of the housing 118 of FIG. 2 with nothing installed therein. As indicated in FIG. 7A, the side walls of the housing 118 are substantially straight, and make an angle of approximately 120° with the outlet axis (vertical in the drawing), or approximately 30° with the inlet axis (horizontal in the drawing). While this design reduces the size of the outlet region 104 to some extent, as compared for example to a hemispherical housing, the conical shape of the housing 118 in FIG. 7A ensures that any longitudinal forces (e.g. forces that are parallel to the inlet axis, horizontal in FIG. 7A) applied to the pump housing 118 will be mainly or entirely compressive, and will not tend to bend or otherwise distort the housing 118. As a result, the pump housing 118 can be made thinner and lighter than for non-conical designs.

FIG. 7A further shows the wall support ribs 700 that are formed in embodiments in the conical wall of the pump housing 118 by the cusps of the scalloped interior surface of the wall. This scalloped shape can be more easily seen in FIG. 7B, which is a sectional view from below drawn to scale of the housing of FIG. 7A. FIG. 7C is a side view drawn to scale of the pump housing 118 of FIGS. 7A and 7B. The conical shape of the side wall of the housing 118 is clearly visible.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the invention is not limited to just these forms, but is amenable to various changes and modifications without departing from the spirit thereof. The disclosure presented herein does not explicitly disclose all possible combinations of features that fall within the scope of the invention. In particular, the limitations presented in dependent claims below, as well as features described in the specification which may not appear in the claims, can be combined in any number and in any order without departing from the scope of the invention, unless the limitations and/or features are logically incompatible with each other.

We claim:

1. A diaphragm pump for pumping a process fluid, the diaphragm pump comprising:

a pump housing having an outer wall;

an inlet region within the pump housing into which process fluid flows in an inlet direction;

an outlet region within the pump housing from which process fluid flows out in an outlet direction, the outlet region being separated from the inlet region by a separating boundary;

a pumping zone that is separated from the inlet region by at least one inlet valve, and from the outlet region by at least one outlet valve, the pumping zone being partially bounded by a flexible diaphragm;

a bypass valve that penetrates the separating boundary, the bypass valve being configured, when open, to allow process fluid to flow from the outlet region into the inlet region;

a bypass spring having a proximal end and a distal end, the proximal end of the bypass spring being in pressing communication with the bypass valve; and a support insert having a top end in pressing communication with the distal end of the bypass spring, the support insert being held in position within the housing by the bypass valve spring and by direct physical contact with at least one of the pump housing, the separating boundary, and a valve support structure that supports at least one of the inlet valve and the outlet valve, without attachment thereto.

2. The diaphragm pump of claim 1, wherein the outlet region surrounds the inlet region.

3. The diaphragm pump of claim 2, wherein the separating boundary is substantially cylindrical.

4. The diaphragm pump of claim 2, wherein the separating boundary includes a first boundary segment that is unitary with the pump housing and a second boundary segment that is unitary with the valve support structure.

5. The diaphragm pump of claim 1, wherein the the support insert makes direct physical contact with the pump housing.

6. The diaphragm pump of claim 1, wherein the support insert makes direct physical contact with the valve support structure.

7. The diaphragm pump of claim 1, wherein the support insert includes an insert body having a left face and a right face, the left and right faces being separated by a thickness that is less than a width of the left and right faces, the top of the insert body being terminated by a top extension having a flat upper surface that extends beyond the left and right faces of the insert body.

8. The diaphragm pump of claim 7, wherein the insert body is positioned to allow process fluid to flow in the inlet region past the left and right faces of the insert body.

9. The diaphragm pump of claim 7, wherein at least one of the housing, the separating boundary, and the valve support structure includes a slot into which a base of the insert body is inserted.

10. The diaphragm pump of claim 1, wherein the outer wall of the pump housing is shaped substantially as a truncated cone, extending at its smaller end to a pump inlet and at its larger end to a pump base.

11. The diaphragm pump of claim 10, wherein the outer wall of the pump housing makes an angle of 30 degrees with the central axis of the truncated cone.

12. The diaphragm pump of claim 1, wherein an inner surface of the outer wall of the pump housing is cycloid shaped, cusps of the cycloid extending inward to form thickened regions of the pump housing outer wall, and rounded segments of the cycloid curving outward to form thinned regions of the pump housing outer wall.

13. The diaphragm pump of claim 12, wherein at least one of the thickened regions at the base of the pump housing outer wall includes a threaded hole configured to accept an assembly screw.

14. The diaphragm pump of claim 1, wherein the valve support structure supports the inlet and outlet valves and divides the pumping zone from the inlet and outlet regions, and makes direct physical contact with the support insert so as to prevent the support insert from moving in a direction parallel to the inlet direction.

15. The diaphragm pump of claim 1, wherein the inlet direction is substantially perpendicular to the outlet direction.

16. The diaphragm pump of claim 1, wherein the valve support structure can be removed from the pump housing so as to provide an opening through which the bypass valve, bypass spring, and support insert can be installed and removed from the pump.

* * * * *